US010673117B2

(12) United States Patent
Hirota et al.

(10) Patent No.: US 10,673,117 B2
(45) Date of Patent: Jun. 2, 2020

(54) WAVEGUIDE CIRCUIT

(71) Applicant: MITSUBISHI ELECTRIC CORPORATION, Tokyo (JP)

(72) Inventors: Akimichi Hirota, Tokyo (JP); Takeshi Oshima, Tokyo (JP); Naofumi Yoneda, Tokyo (JP); Jun Nishihara, Tokyo (JP); Hiroyuki Nonomura, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 16/075,776

(22) PCT Filed: Mar. 22, 2016

(86) PCT No.: PCT/JP2016/058973
§ 371 (c)(1),
(2) Date: Aug. 6, 2018

(87) PCT Pub. No.: WO2017/163310
PCT Pub. Date: Sep. 28, 2017

(65) Prior Publication Data

US 2019/0058233 A1 Feb. 21, 2019

(51) Int. Cl.
*H01P 5/12* (2006.01)
*H01P 5/02* (2006.01)
(Continued)

(52) U.S. Cl.
CPC ..... *H01P 5/12* (2013.01); *H01P 1/025* (2013.01); *H01P 1/24* (2013.01); *H01P 3/12* (2013.01);
(Continued)

(58) Field of Classification Search
CPC .... H01P 5/12; H01P 3/12; H01P 1/025; H01P 1/24; H01P 5/02
(Continued)

(56) References Cited

U.S. PATENT DOCUMENTS 3,375,472 A 3/1968 Walker
5,874,867 A 2/1999 Oguma et al.
(Continued)

FOREIGN PATENT DOCUMENTS

JP 2005-159767 A 6/2005

OTHER PUBLICATIONS

Extended European Search Report dated Jan. 7, 2019 in corresponding European Patent Application No. 16895346.1.

*Primary Examiner* — Robert J Pascal
*Assistant Examiner* — Kimberly E Glenn
(74) *Attorney, Agent, or Firm* — Birch, Stewart, Kolasch & Birch, LLP

(57) ABSTRACT

A waveguide circuit (1) includes a first waveguide tube (10), a second waveguide tube (20), and a third waveguide tube (30). The first waveguide tube (10), the second waveguide tube (20), and the third waveguide tube (30) have cross-sectional shapes to allow propagation of TE modes. The tube axis of the second waveguide tube (20) is parallel to the tube axis of the first waveguide tube (10). One of the narrow sidewalls of the second waveguide tube (20) faces a narrow sidewall (10*s*) of the first waveguide tube (10). The third waveguide tube (30) includes a coupler that connects a hollow guide of the third waveguide tube (30) to a hollow guide of the first waveguide tube (10) and a hollow guide of the second waveguide tube (20).

15 Claims, 11 Drawing Sheets

(51) Int. Cl.

| | |
|---|---|
| ***H01P 5/18*** | (2006.01) |
| ***H01P 5/20*** | (2006.01) |
| ***H01P 1/02*** | (2006.01) |
| ***H01P 1/24*** | (2006.01) |
| ***H01P 3/12*** | (2006.01) |

(52) U.S. Cl.
CPC ..... *H01P 5/02* (2013.01); *H01P 5/182* (2013.01); *H01P 5/20* (2013.01)

(58) Field of Classification Search
USPC ..... 333/125
See application file for complete search history.

(56) References Cited

U.S. PATENT DOCUMENTS

| | | | | |
|---|---|---|---|---|
| 6,483,396 | B1 | 11/2002 | Kwon et al. | |
| 2012/0056669 | A1 | 3/2012 | Fraysse et al. | |
| 2015/0340752 | A1* | 11/2015 | Nantista ..... | H01P 1/165 333/117 |

* cited by examiner

WAVEGUIDE CIRCUIT

TECHNICAL FIELD

The present invention relates to a waveguide circuit for power combining or power splitting in radio frequency bands.

BACKGROUND ART

Waveguide tubes are commonly used structures for combining or splitting a power in a radio-frequency band such as a microwave band or a millimeter-wave band. For example, the radio-frequency power combining using a waveguide circuit has been performed to implement the high output power capability of radio-frequency power sources or radio-frequency transmitters. A prior art document concerning such a waveguide circuit is, for example, Patent Literature 1 (Japanese Patent Application Publication No. 2005-159767).

Patent Literature 1 discloses a branch structure of a waveguide structure for the radio-frequency power combining or splitting. In the branch structure, the end portion of a first waveguide tube and a second waveguide tube are arranged to be orthogonal and overlapped with each other. In the overlapped area between the end portion of the first waveguide tube and the second waveguide tube, a coupling window formed in a sidewall of the end portion is in communication with a coupling window formed in a sidewall of the second waveguide tube. The branch structure, upon receiving radio-frequency powers through both ends of the second waveguide tube, is capable of combining the received radio-frequency powers to thereby generate a composite power, and outputting the composite power to the first waveguide tube through the coupling windows. Thus, the branch structure can combine two input radio-frequency powers to generate a single output composite power.

CITATION LIST

Patent Literature

Patent Literature 1: Japanese Patent Application Publication No. 2005-159767 (for example, FIGS. 1, 2 and 10, and paragraphs [0019] and [0052]).

SUMMARY OF INVENTION

Technical Problem

There has been demand in recent years to miniaturize the scale of the waveguide circuit capable of performing the radio-frequency power combining or splitting at low loss. However, because many branch structures are required for implementation of the waveguide circuit capable of performing the radio-frequency power combining of more than two inputs using a prior art disclosed in Patent Literature 1, there is the problem that it is difficult to miniaturize the whole scale of the waveguide circuit. For example, for implementation of a waveguide circuit capable of combining radio-frequency powers of eight ($=2^3$) inputs in accordance with a tournament or binary-tree method, seven branch structures are required. In such a case, the overall structure of the waveguide circuit capable of performing the power combining in accordance with the tournament or binary-tree method needs to be a multilayer structure and increases in complexity, which makes it difficult to build low cost.

In view of the foregoing, it is an object of the present invention to provide a waveguide circuit that has a relatively simple structure and allows for miniaturization.

Solution to Problem

In accordance with an aspect of the present invention, there is provided a waveguide circuit which includes: a first waveguide tube having a first cross-sectional shape to allow propagation of a TE mode; a second waveguide tube disposed adjacent to the first waveguide tube and having a second cross-sectional shape to allow propagation of a TE mode; and a third waveguide tube having a tube axis perpendicular to both a tube axis of the first waveguide tube and a tube axis of the second waveguide tube, and having a third cross-sectional shape to allow propagation of a TE mode. The first cross-sectional shape has a pair of straight-line long sides facing each other and a pair of straight-line short sides facing each other, in a plane orthogonal to the tube axis of the first waveguide tube. The second cross-sectional shape has a pair of straight-line long sides facing each other and a pair of straight-line short sides facing each other, in a plane orthogonal to the tube axis of the second waveguide tube. The first waveguide tube has a pair of sidewalls which form the pair of straight-line short sides of the first cross-sectional shape. The second waveguide tube has a pair of sidewalls which form the pair of straight-line short sides of the second cross-sectional shape. The pair of straight-line long sides of the second cross-sectional shape is parallel to the pair of straight-line long sides of the first cross-sectional shape. The tube axis of the second waveguide tube is parallel to the tube axis of the first waveguide tube. One sidewall of the pair of sidewalls of the second waveguide tube is disposed to face one sidewall of the pair of sidewalls of the first waveguide tube. The third waveguide tube includes a coupler which connects a hollow guide of the third waveguide tube to both a hollow guide of the first waveguide tube and a hollow guide of the second waveguide tube.

Advantageous Effects of Invention

According to the present invention, the waveguide circuit that has a relatively simple structure and allows for miniaturization can be provided.

DESCRIPTION OF EMBODIMENTS

Figure 1:
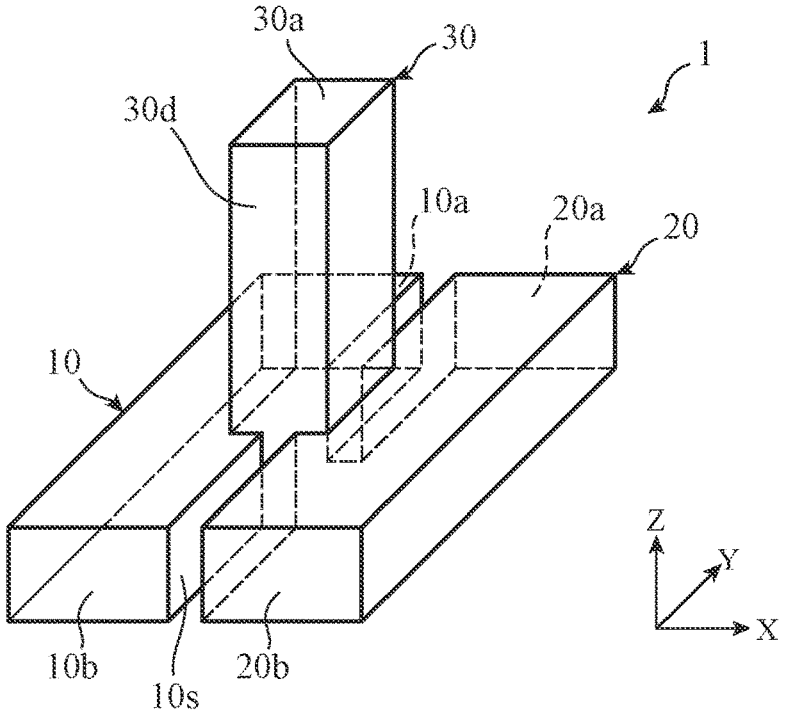
FIG. 1 is a schematic perspective view of a waveguide circuit that is a first embodiment according to the present invention.

Various embodiments according to the present invention will now be described in detail with reference to the accompanying drawings. The components indicated by the same reference signs in the drawings have the same configuration and function.

First Embodiment

FIG. 1 is a schematic perspective view of a waveguide circuit 1 that is a first embodiment according to the present invention. The waveguide circuit 1 has a structure capable of performing the power combining or splitting in a radio-frequency band such as a VHF band, a UHF band, a microwave band or a millimeter-wave band.

With reference to FIG. 1, the waveguide circuit 1 includes a first waveguide tube 10 having a first cross-sectional shape that allows propagation of an electromagnetic wave of a transverse electric mode (TE mode), a second waveguide tube 20 disposed adjacent to the first waveguide tube 10 and having a second cross-sectional shape to allow propagation of an electromagnetic wave of a TE mode, and a third waveguide tube 30 disposed to intersect with both the first waveguide tube 10 and the second waveguide tube 20 and having a third cross-sectional shape to allow propagation of an electromagnetic wave of a TE mode. Each of the first waveguide tube 10, the second waveguide tube 20, and the third waveguide tube 30 is a rectangular waveguide, made from metal, which includes a hollow waveguide (hereinafter also simply referred to as a "hollow guide") having a rectangular cross-sectional shape in a plane orthogonal to the tube axis of the rectangular waveguide. Each hollow guide extends completely through its corresponding waveguide tube along its tube axis. The tube axis of the first waveguide tube 10 is parallel to the tube axis of the second waveguide tube 20. The Y-axis in FIG. 1 is parallel to the tube axes of the first and second waveguide tubes 1C and 20; and the Z-axis in FIG. 1 is parallel to the tube axis of the third waveguide tube 30 and orthogonal to the Y-axis. The X-axis in FIG. 1 is orthogonal to both the Y-axis and the Z-axis.

Figure 2:
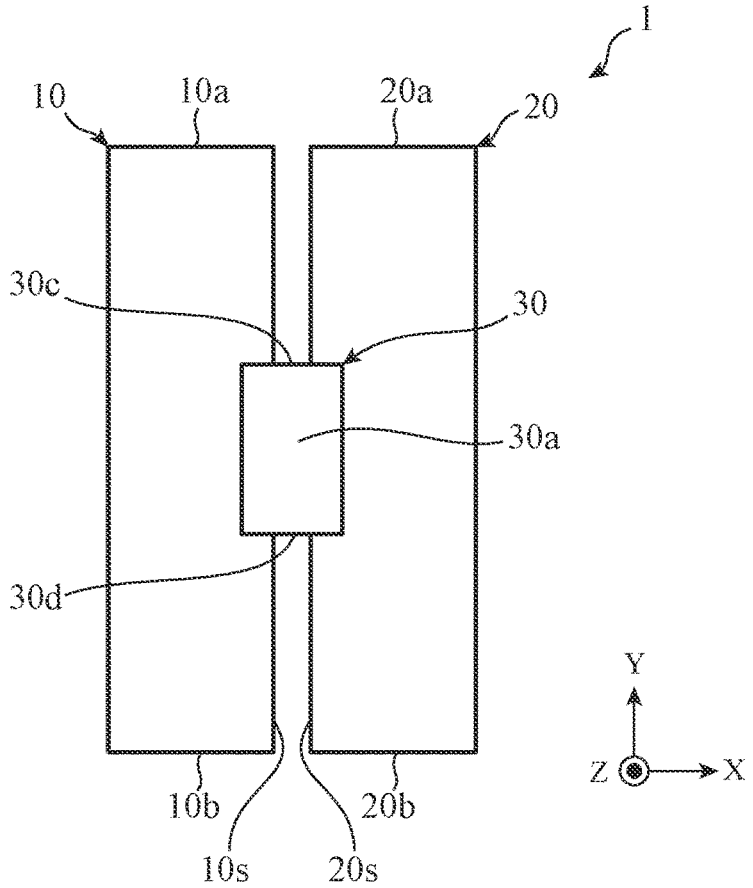
FIG. 2 is a top view of the waveguide circuit of the first embodiment.
Figure 3:
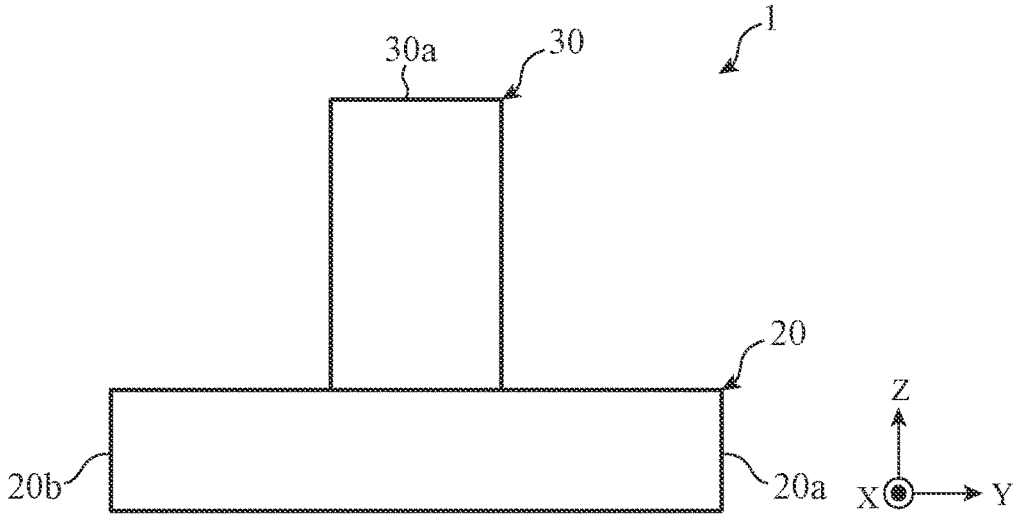
FIG. 3 is a right side view of the waveguide circuit of the first embodiment.

FIG. 2 is a top view of the waveguide circuit 1 in FIG. 1 viewed from the positive direction of the Z-axis. FIG. 3 is a right side view of the waveguide circuit 1 in FIG. 1 viewed from the positive direction of the X-axis.

With reference to FIGS. 1 to 3, the first waveguide tube 10 includes input/output ends 10*a* and 10*b* at both ends of the first waveguide tube 10 in the Y-axis direction (tube axis direction). The input/output ends 10*a* and 10*b* are electromagnetically connected to first and second input/output terminals (not shown) for transmitting radio-frequency powers, respectively. The second waveguide tube 20 includes input/output ends 20*a* and 20*b* at both ends of the second waveguide tube 20 in the Y-axis direction (tube axis direction). The input/output ends 20*a* and 20*b* are electromagnetically connected to third and fourth input/output terminals (not shown) for transmitting radio-frequency powers, respectively. When the waveguide circuit 1 functions as a power-combining circuit that combines radio-frequency powers of four inputs, the input/output ends 10*a*, 10*b*, 20*a*, and 20*b* serve as input ends or input ports that receive the radio-frequency powers, respectively. When the waveguide circuit 1 functions as a power-splitting circuit that evenly splits a radio-frequency power into four radio-frequency powers, the input/output ends 10*a*, 10*b*, 20*a*, and 20*b* serve as output ends or output ports that output the radio-frequency powers, respectively.

Each of the cross-sectional shapes of the first waveguide tube 10 and the second waveguide tube 20 in the X-Z plane is a rectangular shape that has two long sides parallel to the X-axis direction and two short sides parallel to the Z-axis direction. The long and short sides are straight lines. The long sides (longitudinal sides) of the rectangular cross-section of the second waveguide tube 20 and the long sides (longitudinal sides) of the rectangular cross-section of the first waveguide tube 10 are oriented in the same direction. The first waveguide tube 10 and the second waveguide tube 20 each includes two wide sidewalls having widths defining the long sides of the rectangular cross-sectional shape and having normal lines extending in the positive and negative directions of the Z-axis, and two narrow sidewalls having widths defining the short sides of the rectangular cross-sectional shape and having normal lines extending in the positive and negative directions of the X-axis. With reference to FIGS. 1 and 2, the narrow sidewall 10*s* of the first waveguide tube 10 faces the narrow sidewall 20*s* of the second waveguide tube 20. In detail, the short side of the rectangular cross-section of the first waveguide tube 10 on the positive side of X-axis is disposed adjacent to the short side of the rectangular cross-section of the second waveguide tube 20 on the negative side of the X-axis.

The third waveguide tube 30 has a tube axis parallel to the Z-axis direction. The tube axis direction of the third waveguide tube 30 is orthogonal to the tube axis directions of the first waveguide tube 10 and the second waveguide tube 20. The cross-sectional shape of the third waveguide tube 30 in the X-Y plane has two wide sides parallel to the Y-axis direction and two short sides parallel to the X-axis direction. The long and short sides are straight lines. The third waveguide tube 30 includes two wide sidewalls having widths defining the long sides of the rectangular cross-sectional shape of the third waveguide tube 30 and having normal lines extending in the positive and negative directions of the X-axis, and two narrow sidewalls having widths defining the short sides of the rectangular cross-sectional shape of the third waveguide tube 30 and having normal lines extending in the positive and negative directions of the Y-axis. With reference to FIGS. 1 and 2, the narrow sidewalls 30*c* and 30*d* of the third waveguide tube 30 extend along the Z-axis direction and intersect with the narrow sidewall 10*s* of the first waveguide tube 10 and the narrow sidewall 20*s* of the second waveguide tube 20, at an angle of 90°.

The third waveguide tube 30 includes an input/output end 30*a* at a first end of the third waveguide tube 30. The input/output end 30*a* is electromagnetically connected to a fifth input/output terminal (not shown) for transmitting a radio-frequency power. When the waveguide circuit 1 functions as a power-combining circuit that combines radio-frequency powers of four inputs, the input/output end 30*a* serves as an output end or output port that outputs a composite power. While the waveguide circuit 1 functions as a power-splitting circuit that evenly splits a radio-frequency power into four radio-frequency powers, the input/output end 30*a* serves as input ends or input ports that receive the radio-frequency power.

The third waveguide tube 30 has a second end at the trailing end portion of the hollow guide of the third waveguide tube 30. The second end is a coupler (coupling space) that connects the hollow guide of the third waveguide tube 30 to the hollow guides of the first waveguide tube 10 and the second waveguide tube 20.

Figure 4:
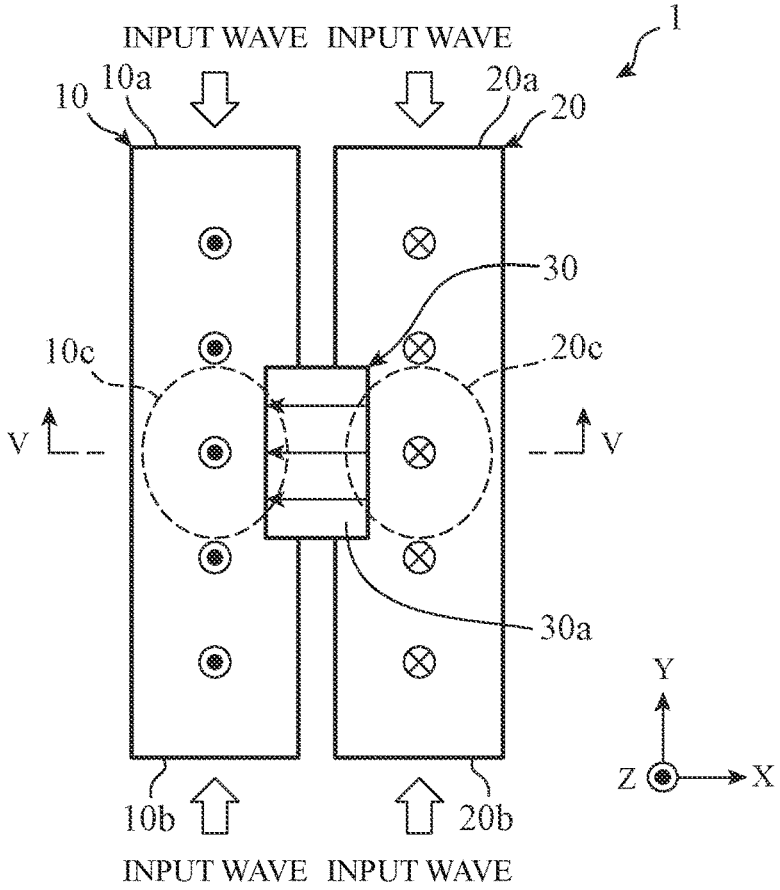
FIG. 4 is a schematic top view illustrating an electric field distribution in the waveguide circuit of the first embodiment.
Figure 5:
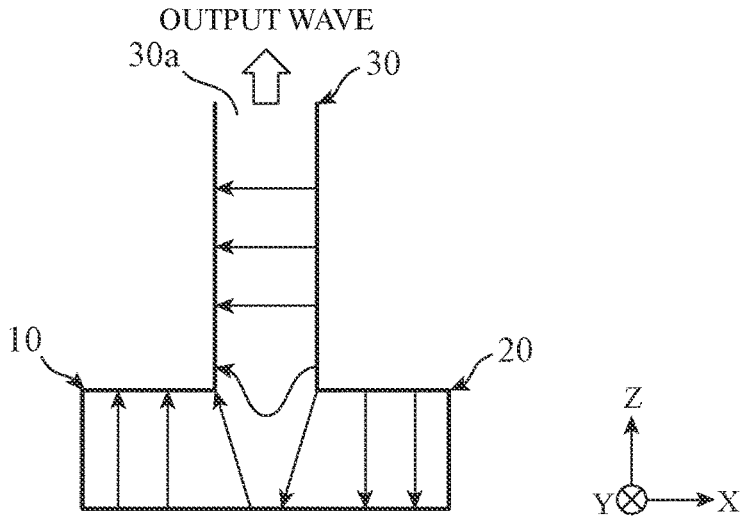
FIG. 5 is a cross-sectional view of the waveguide circuit taken along line V-V in FIG. 4.

Referring to FIGS. 4 and 5, an example operation of the waveguide circuit 1 functioning as a power-combining circuit will now be explained. FIG. 4 is a schematic view illustrating an electromagnetic distribution in the waveguide circuit 1 as viewed from the positive direction of the Z-axis. FIG. 5 is a cross-sectional view of the waveguide circuit 1 taken along line V-V in FIG. 4. In FIGS. 4 and 5, the directions of the electric fields propagating through the first waveguide tube 10, the second waveguide tube 20, and the third waveguide tube 30 are indicated by arrows.

The input/output ends 10*a* and 10*b* of the first waveguide tube 10 receive in-phase radio-frequency waves having equal amplitudes of the $TE_{10}$ mode (fundamental mode). With reference to FIG. 4, the direction of the electric field of the $TE_{10}$ mode input to the input/output end 10*a* is the same as the direction of the electric field of the $TE_{10}$ mode input to the input/output end 10*b*. The radio-frequency powers input to the respective input/output ends 10*a* and 10*b* are combined in the central portion 10*c* of the third waveguide tube 30 at and near the coupler. The input/output ends 20*a* and 20*b* of the second waveguide tube 20 receive radio-frequency waves of the $TE_{10}$ modes (fundamental modes) which have equal amplitudes and opposite phases to each other. With reference to FIG. 4, the direction of the electric field of the $TE_{10}$ mode input to the input/output end 20*a* is the same as the direction of the electric field of the $TE_{10}$ mode input to the input/output end 20*b*. The radio-frequency waves input to the input/output ends 20*a* and 20*b* respectively are combined at the central portion 20*c* of the third waveguide tube 30 near the coupler. In this regard, the radio-frequency wave generated by by the combining in the central portion 10*c* and the radio-frequency wave generated by the combining in the central portion 20*c* have equal amplitudes and opposite phases to each other (phases shifted from each other by 180°. The radio-frequency wave in the central portion 10*c* of the first waveguide tube 10 and the radio-frequency wave in the central portion 20*c* of the second waveguide tube 20 are combined at the coupler. The combined radio-frequency waves propagate through the hollow guide of the third waveguide tube 30 for output from the input/output end 30*a* as illustrated in FIG. 5.

As described above, upon receiving radio-frequency powers from the input/output ends 10*a* and 10*b* of the first waveguide tube 10 and receiving radio-frequency powers from the input/output ends 20*a* and 20*b* of the second waveguide tube 20, the waveguide circuit 1 of the first embodiment is capable of combining the radio-frequency powers of four inputs to thereby generate a composite power, and outputting the composite power from the input/output end 30*a* of the third waveguide tube 30. As described above, because the branch structure disclosed in Patent Literature 1 can combine radio-frequency powers of only two inputs, three branch structures are required for the combining of radio-frequency powers of four inputs in accordance with a tournament or binary-tree method. In contrast, the waveguide circuit of the present embodiment can combine radio-frequency powers of four inputs at low loss without requiring the tournament or binary-tree method. Thus, the structure of the waveguide circuit 1 of the present embodiment readily enables a decrease in size.

Figure 6:
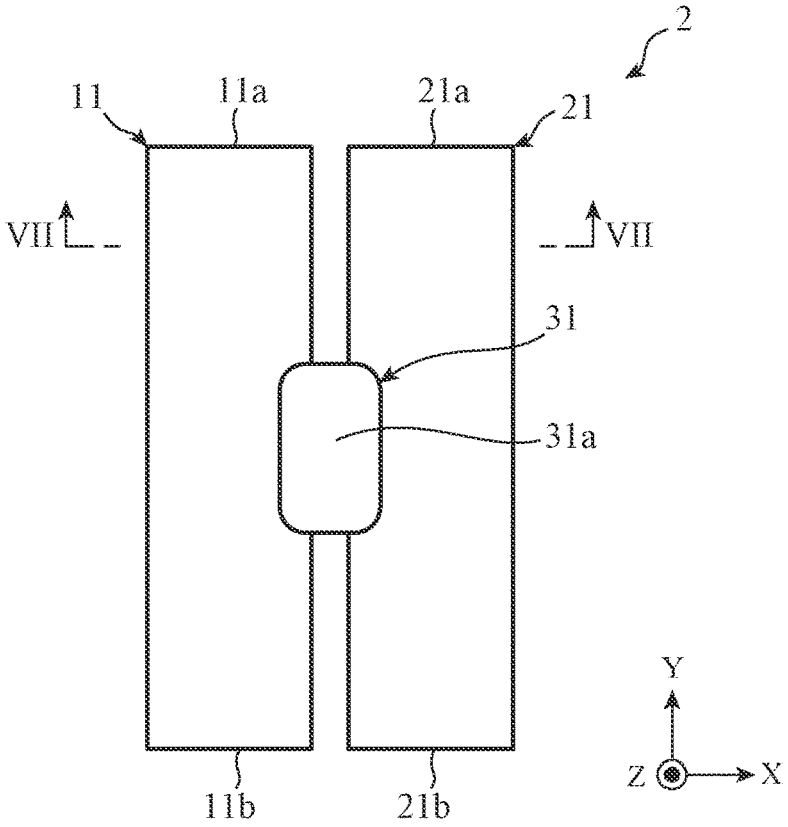
FIG. 6 is a top view of a waveguide circuit that is a modified embodiment from the first embodiment.
Figure 7:
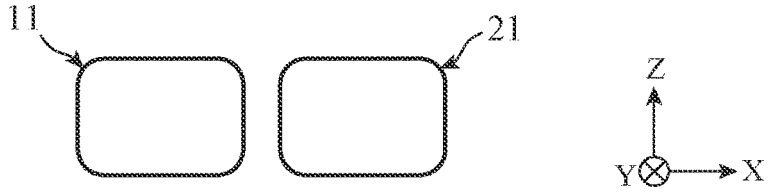
FIG. 7 is a cross-sectional view of the waveguide circuit of the modified embodiment from the first embodiment.

In the present embodiment, the cross-sectional shape of each of the first waveguide tube 10, the second waveguide tube 20 and the third waveguide tube 30 has four corner portions with a vertex angle of 90°, although no limitation thereto is intended. FIGS. 6 and 7 are schematic views of the configuration of a waveguide circuit 2 that is a modified embodiment from the first embodiment. FIG. 6 is a top view of the waveguide circuit 2 viewed from the positive direction of the Z-axis. FIG. 7 is a cross-sectional view of the waveguide circuit 2 taken along line VII-VII in FIG. 6. The configuration of the waveguide circuit 2 of the modified embodiment is the same as that of the waveguide circuit 1 of the first embodiment, except that the first waveguide tube 10, the second waveguide tube 20, and the third waveguide tube 30 are replaced with a first waveguide tube 11, a second waveguide tube 21, and a third waveguide tube 31, respectively, illustrated in FIG. 6. The structures of the first waveguide tube 11, the second waveguide tube 21, and the third waveguide tube 31 are the same as those of the first waveguide tube 10, the second waveguide tube 20, and the third waveguide tube 30, except for the cross-sectional shapes.

With reference to FIG. 6, the cross-sectional shape of the third waveguide tube 31 has two parallel long sides, two parallel short sides, and four rounded corner portions in the X-Y plane. With reference to FIG. 7, the cross-sectional shape of the first waveguide tube 11 has two parallel long sides, two parallel short sides, and four rounded corner portions in the X-Z plane. Similarly, the cross-sectional shape of the second waveguide tube 21 has two parallel long sides, two parallel short sides, and four rounded corner portions in the X-Z plane.

Similar to the waveguide circuit 1 described above, upon receiving radio-frequency powers from input/output ends 11*a* and 11*b* of the first waveguide tube 11 and receiving radio-frequency powers from input/output ends 21*a* and 21*b* of the second waveguide tube 20, the waveguide circuit 2 can combine the radio-frequency powers of four inputs to thereby generate a composite power, and can output the composite power from an input/output end 31*a* of the third waveguide tube 31.

In the second to fourth embodiments as will be described below, rectangular waveguides having rectangular cross-sectional shapes are also used. In place of the rectangular waveguides, waveguides each of which has four rounded corner portions, such as the first waveguide tube 11, second waveguide tube 21 and third waveguide tube 31 of the modified embodiment, may be used.

Second Embodiment

Figure 8:
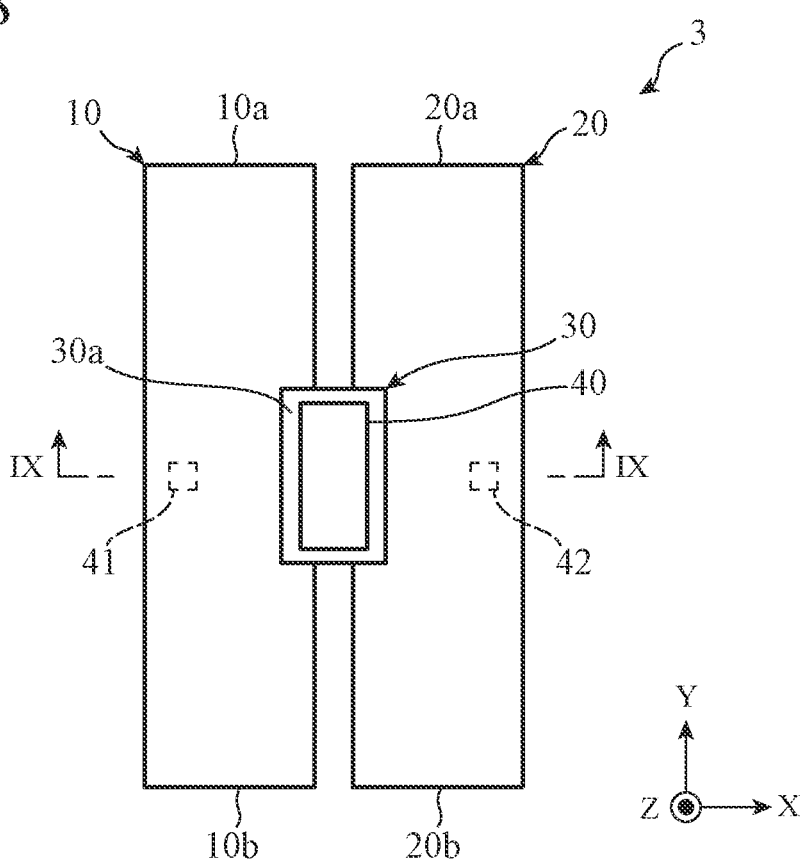
FIG. 8 is a top view of a waveguide circuit that is a second embodiment according to the present invention.
Figure 9:
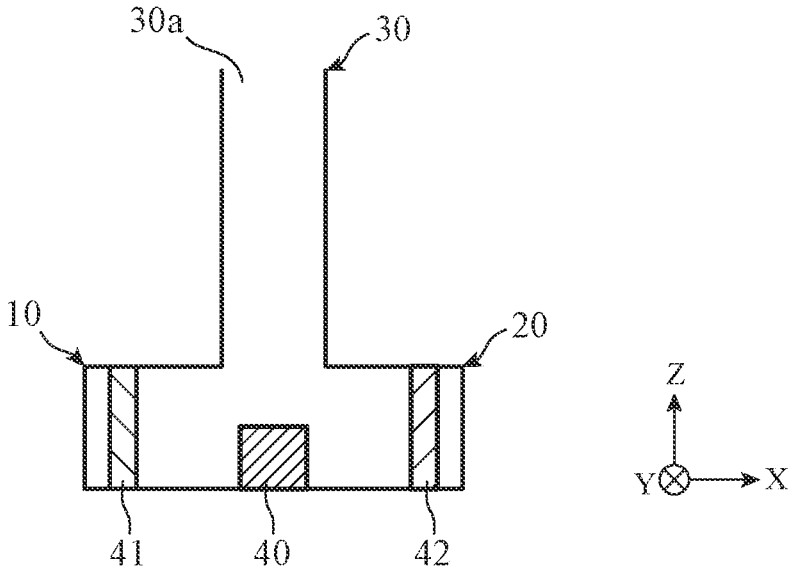
FIG. 9 is a cross-sectional view of the waveguide circuit taken along line IX-IX in FIG. 8.

A second embodiment according to the present invention will now be described. FIGS. 8 and 9 are schematic views of the configuration of a waveguide circuit 3 that is the second embodiment according to the present invention. FIG. 8 is a top view of the waveguide circuit 3 viewed from the positive direction of the Z-axis. FIG. 9 is a cross-sectional view of the waveguide circuit 3 taken along line IX-IX in FIG. 8.

The waveguide circuit 3 of the present embodiment has the same configuration as the waveguide circuit 1 of the first embodiment. Besides this configuration, the waveguide circuit 3 includes three matching elements 40, 41, and 42 that alleviate the impedance mismatching among the first waveguide tube 10, the second waveguide tube 20, and the third waveguide tube 30, as illustrated in FIGS. 8 and 9. The matching elements 40, 41, and 42 may be composed of conductors, such as metals.

The matching element 40 is disposed in the central area of the coupler on the tube axis (central axis) of the third waveguide tube 30. The matching element 41 is disposed in the hollow guide in the first waveguide tube 10 a predetermined distance away from the center of the coupler of the third waveguide tube 30 in the negative direction of the X-axis. With reference to FIG. 9, the matching element 41 is in the form of a post protruding orthogonal to the tube axis of the first waveguide tube 10 (the positive direction of the Z-axis) and electrically connects the top and bottom walls of the first waveguide tube 10 to each other. The matching element 42 is disposed in the hollow guide in the second waveguide tube 20 a predetermined distance away from the center of the coupler of the third waveguide tube 30 in the positive direction of the X-axis. With reference to FIG. 9, the matching element 42 is in the form of a post protruding orthogonal to the tube axis of the second waveguide tube 20 (the positive direction of the Z-axis) and electrically connects the top and bottom walls of the second waveguide tube 20 to each other. In view of alleviation of the impedance mismatching, it is preferred that the matching elements 41 and 42 each be disposed in an area away from the center of the coupler by a distance smaller than or equal to one half of the wavelength corresponding to a predetermined radio-frequency band.

Figure 10:
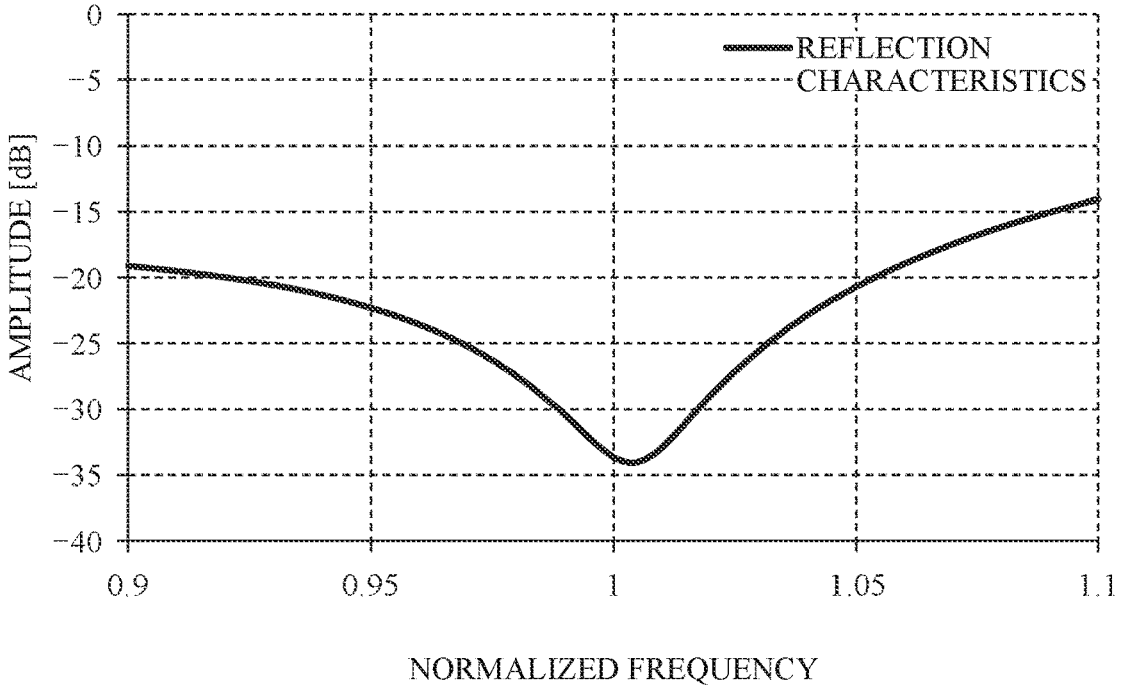
FIG. 10 is a graph illustrating the results of an electromagnetic field analysis performed with the waveguide circuit of the second embodiment.

FIG. 10 is a graph illustrating the results of an electromagnetic analysis performed with the waveguide circuit 3 of the present embodiment. This graph represents the reflection characteristics in the input/output end 30*a* of the third waveguide tube 30. In the graph, the horizontal axis represents normalized frequency and the vertical axis represents amplitude (magnitude) (unit: dB). The graph in FIG. 10 demonstrates that satisfactory reflection characteristics are achieved at and near the central or normalized frequency "1". It should be understood that the result and the reciprocity theorem suggest that the power combining at low loss can be performed at and near the central frequency without any impedance mismatching.

It is preferred that the present embodiment includes all three matching elements 40, 41, and 42 to alleviate the impedance mismatching. However, the impedance mismatching can be alleviated to a certain degree by providing at least one of the matching elements 40, 41, and 42.

As described above, the waveguide circuit 3 of the second embodiment includes the matching elements 40, 41, and 42, which can alleviate the impedance mismatching at the coupler connecting the hollow guides of the first waveguide tube 10, the second waveguide tube 20, and the third waveguide tube 30 in comparison to the first embodiment. This reduces electrical loss.

Third Embodiment

Figure 11:
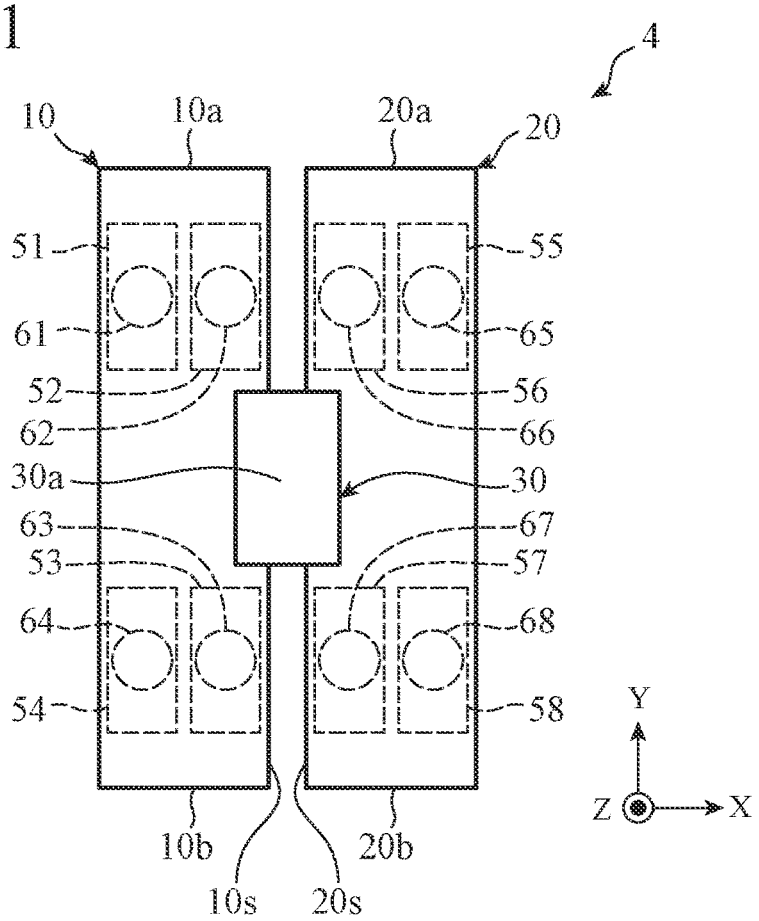
FIG. 11 is a top view of a waveguide circuit that is a third embodiment according to the present invention.
Figure 12:
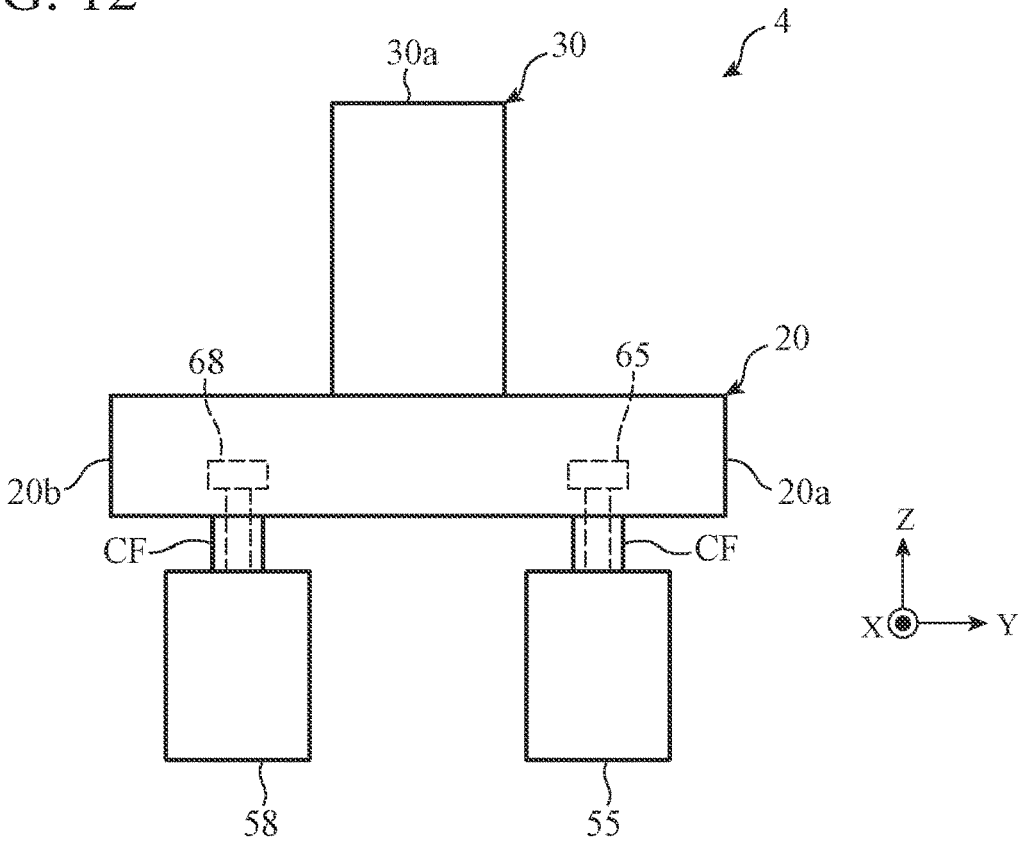
FIG. 12 is a right side view of the waveguide circuit of the third embodiment.

A third embodiment according to the present invention will now be described. FIGS. 11 and 12 are schematic view of the configuration of a waveguide circuit 4 that is the fourth embodiment according to the present invention. FIG. 11 is a top view of the waveguide circuit 4 viewed from the positive direction of the Z-axis. FIG. 12 is a right side view of the waveguide circuit 4 viewed from the positive direction of the X-axis. The waveguide circuit 4 of the present embodiment has the same configuration as that of the waveguide circuit 1 of the first embodiment, and further includes eight coaxial-to-waveguide transitions for transmitting amplified radio-frequency signals input from eight amplifiers 51 to 58, into the hollow guides of the first waveguide tube 10 and the second waveguide tube 20.

With reference to FIGS. 11 and 12, four amplifiers 51, 52, 53, and 54 that supply amplified radio-frequency signals are disposed below the first waveguide tube 10 (in the negative direction of the Z-axis), and four amplifiers 55, 56, 57, and 58 that supply amplified radio-frequency signals are disposed below the second waveguide tube 20 (in the negative direction of the Z-axis). The amplifiers 51 to 58 are shielded by metal casings. Four probes 61, 62, 63, and 64 are disposed at positions corresponding to the amplifiers 51, 52, 53, and 54, respectively, in the hollow guide of the first waveguide tube 10. The probes 61, 62, 63, and 64 are electromagnetically connected to the amplifiers 51, 52, 53, and 54, respectively, through coaxial guides CF such as coaxial cables.

Four probes 65, 66, 67, and 68 are disposed at positions corresponding to the amplifiers 55, 56, 57, and 58, respectively, in the hollow guide of the second waveguide tube 20. The probes 65, 66, 67, and 68 are electromagnetically connected to the amplifiers 55, 56, 57, and 58, respectively, through coaxial guides CF such as coaxial cables. The probes 61 to 68 may be composed of any conductor, such as metal.

The probes are electrically connected to the respective inner conductors of the coaxial guides CF. In detail, the tips of the inner conductors of the coaxial guides CF are inserted in the hollow guides of the waveguides and are connected to the corresponding probes. For example, with reference to FIG. 12, the coaxial guide CF connected to the amplifier 55 includes an inner conductor, which is indicated by the dotted lines. The tip of the inner conductor is connected to the lower end of the probe 65. Similarly, the inner conductor of the coaxial guide CF connected to the amplifier 58 is connected to the lower end of the probe 68.

One coaxial guide CF and a corresponding probe constitute one coaxial-to-waveguide transition. With reference to FIG. 11, four coaxial-to-waveguide transitions are disposed in the hollow guide of the first waveguide tube 10 in respective areas on both sides of the coupler of the third waveguide tube 30 in the direction along the tube axis of the first waveguide tube 10. Four coaxial-to-waveguide transitions are disposed in the hollow guide of the second waveguide tube 20 in respective areas on both sides of the coupler in the direction along the tube axis of the second waveguide tube 20.

Exemplary operations of the waveguide circuit 4 functioning as a power-combining circuit will now be described. The amplifiers 51, 52, 53, and 54 supply in-phase amplified radio-frequency signals having equal amplitudes, to the probes 61, 62, 63, and 64, respectively, in the hollow guide of the first waveguide tube 10. The amplified radio-frequency signals are converted to radio-frequency waves of $TE_{10}$ modes and propagate through the first waveguide tube 10. The amplifiers 55 to 58 supply amplified radio-frequency signals which have equal amplitudes and opposite phases, to the probes 65 to 68, respectively, in the hollow guide of the second waveguide tube 20. The amplified radio-frequency signals are converted into radio-frequency waves of the $TE_{10}$ modes and propagate through the second waveguide tube 20. Similar to the first embodiment, the radio-frequency powers of eight inputs are combined. The combined radio-frequency powers propagate through the hollow guide of the third waveguide tube 30 for output from the input/output end 30*a*. The positions of the disposed probes 61 to 68 to the first waveguide tube 10 and the second waveguide tube 20 and the shape of the probes 61 to 68 can be appropriately selected so as to alleviate impedance mismatching between the coaxial guides CF and the first waveguide tube 10 and between the coaxial guides CF and the second waveguide tube 20.

As described above, the waveguide circuit 4 of the third embodiment can combine two amplified radio-frequency signals with two adjacent coaxial-to-waveguide transitions (for example, probes 61 and 62 in the first waveguide tube 10) and can also combine four radio-frequency signals at the coupler of the third waveguide tube 30. Thus, the waveguide circuit 4 of the present embodiment can receive eight amplified radio-frequency signals as inputs and can combine the eight amplified radio-frequency signals.

The number of the coaxial-to-waveguide transitions of the present invention is eight, although no limitation thereto is intended. For example, at least two coaxial-to-waveguide transitions may be disposed in the hollow guide of the first waveguide tube 10, and at least two coaxial-to-waveguide transitions may be disposed in the hollow guide of the second waveguide tube 20. Alternatively, more than eight coaxial-to-waveguide transitions may be provided to achieve a high output power without significantly varying the dimensions of the entire waveguide circuit.

Figure 13:
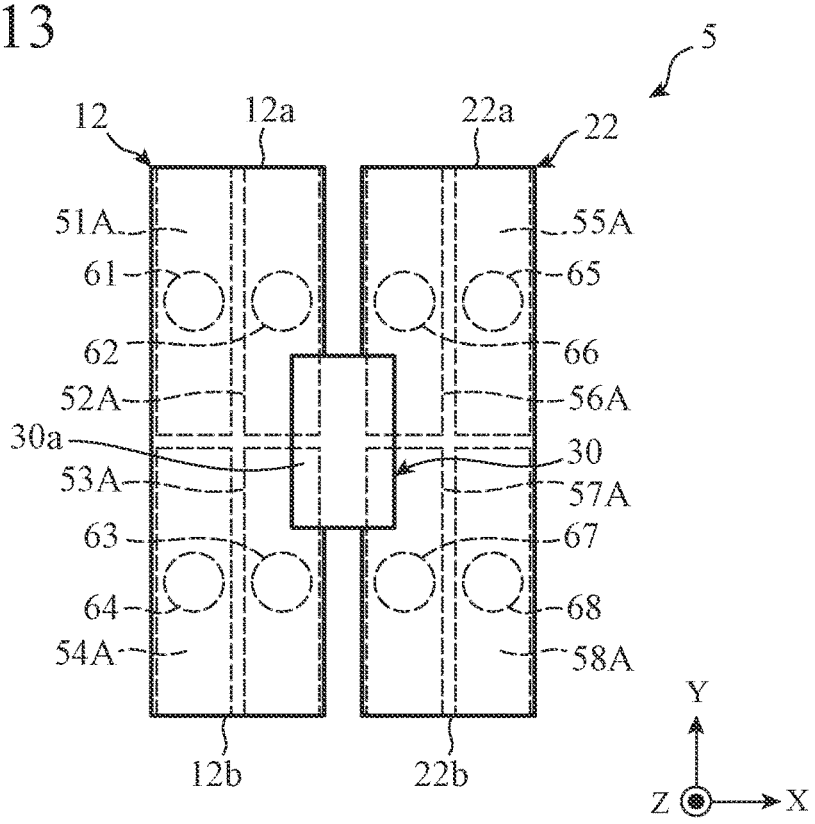
FIG. 13 is a top view of a waveguide circuit that is a modified embodiment from the third embodiment.
Figure 14:
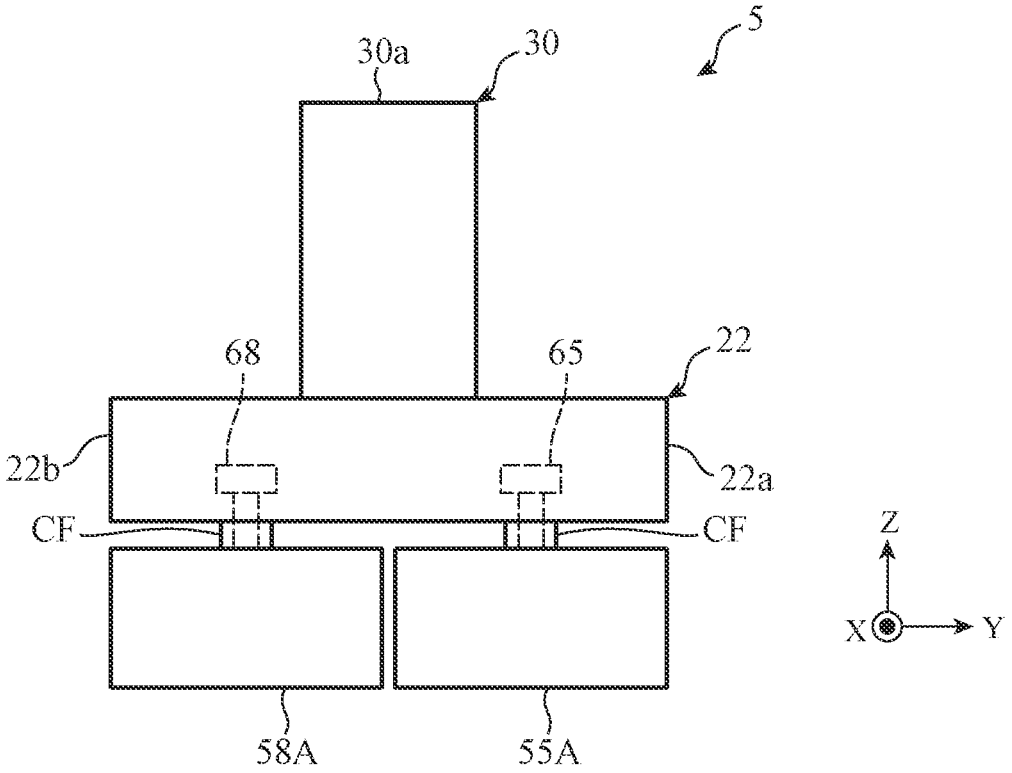
FIG. 14 is a right side view of the waveguide circuit of the modified embodiment from the third embodiment.

The lengths in the longitudinal direction (Y-axis direction) of the first waveguide tube 10 and second waveguide tube 20 and the connection length of the coaxial guides CF can be individually adjusted to reduce the overall scale of the waveguide circuit 4. FIGS. 13 and 14 are schematic views of the configuration of a waveguide circuit 5 that is a modified embodiment from the third embodiment. FIG. 13 is a top view of the waveguide circuit 5 viewed from the positive direction of the Z-axis. FIG. 14 is a right side view of the waveguide circuit 5 viewed from the positive direction of the X-axis.

The waveguide circuit 5 of the modified embodiment includes a first waveguide tube 12, a second waveguide tube 22, and a third waveguide tube 30. With reference to FIG. 13, the distance between both ends 12*a* and 12*b* of the first waveguide tube 12 in the tube axis direction is smaller than that of the first waveguide tube 10. Similarly, the distance between both ends 22*a* and 22*b* of the second waveguide tube 22 in the tube axis direction is smaller than that of the second waveguide tube 20. The structure of the first waveguide tube 12 is the same as that of the first waveguide tube 10, except that the longitudinal length of the first waveguide tube 12 is smaller than that of the first waveguide tube 10. The structure of the second waveguide tube 22 is the same as that of the second waveguide tube 20, except that the longitudinal length of the second waveguide tube 22 is smaller than that of the second waveguide tube 20.

With reference to FIGS. 13 and 14, the configuration of amplifiers 51A to 58A are the same as that of the amplifiers 51 to 58, respectively, except for the external dimensions. With reference to FIG. 14, the distances between the amplifiers 51A to 55A and the first waveguide tube 10 and the distances between the amplifiers 55A to 58A and the second waveguide tube 20 are small compared to those in the third embodiment (FIG. 12).

The amplifiers 51A to 58A can be disposed substantially with no gap therebetween, as illustrated in FIG. 13. Thus, the waveguide circuit 5 can have an overall small size.

Similar to the waveguide circuit 4, the waveguide circuit 5 of the modified embodiment can combine radio-frequency powers input through the respective amplifiers 51A to 58A to thereby generate a composite power, and can output the composite power from the input/output end 31*a* of the third waveguide tube 31.

In the present embodiment, the ends 10*a* and 10*b* of the first waveguide tube 10 and the ends 20*a* and 20*b* of the second waveguide tube 20 are closed and not used as input/output ports, although no limitation thereto is intended. The ends 10*a*, 10*b*, 20*a*, and 20*b* may be connected to other waveguides or other coaxial-to-waveguide transitions. Similarly, in the modified embodiment, the ends 12*a* and 12*b* of the first waveguide tube 12 and the ends 22*a* and 22*b* of the second waveguide tube 22 are closed, although no limitation thereto is intended. The ends 12*a*, 12*b*, 22*a*, and 22*b* may be connected to other waveguides or other coaxial-to-waveguide transitions.

Fourth Embodiment

Figure 15:
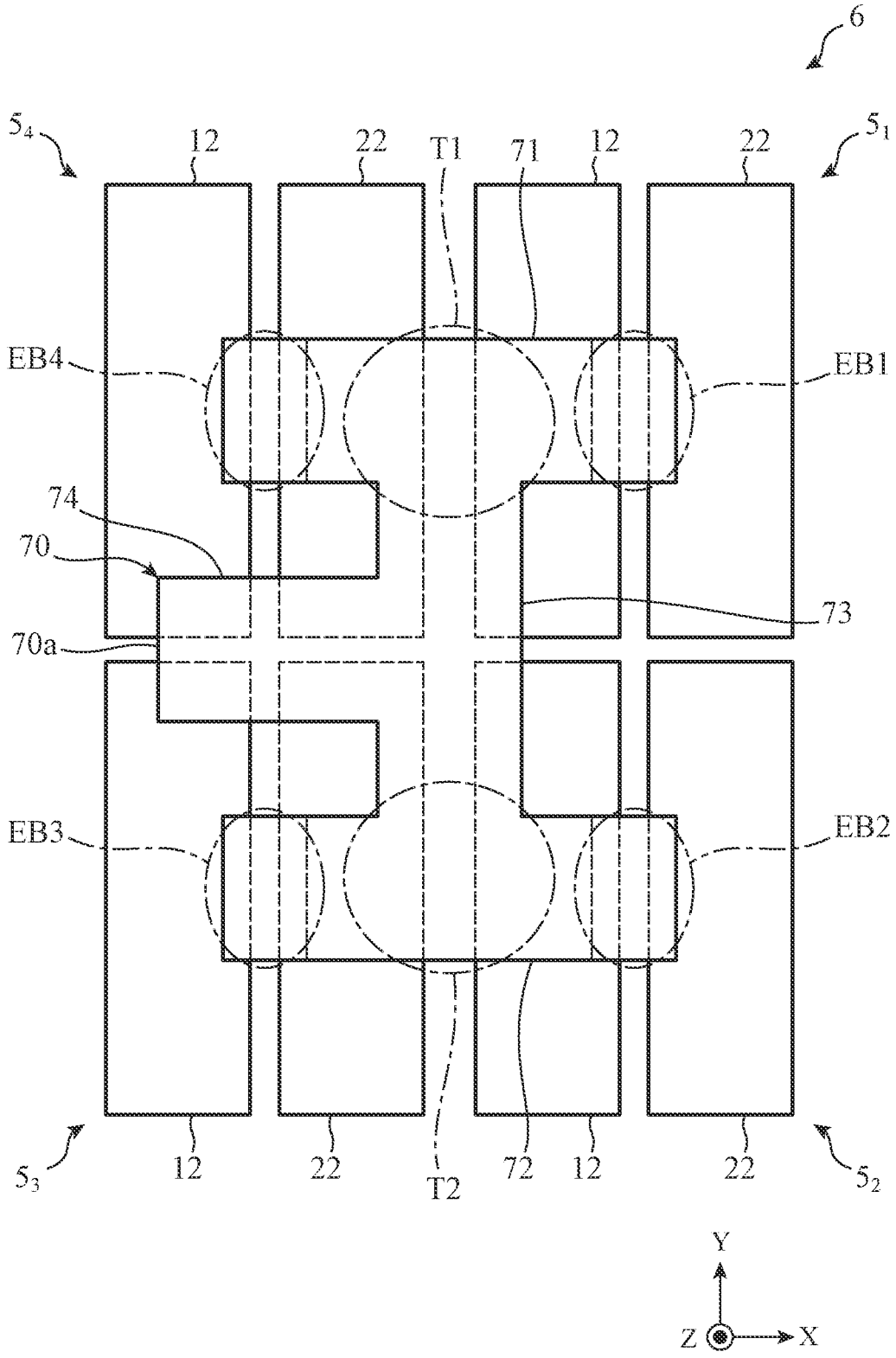
FIG. 15 is a schematic view of the configuration of an arrayed-waveguide circuit that is a fourth embodiment according to the present invention.

A fourth embodiment according to the present invention will now be described. FIG. 15 is a schematic view of the configuration of an arrayed-waveguide circuit 6 that is the fourth embodiment according to the present invention. FIG. 15 is a top view of the arrayed-waveguide circuit 6 viewed from the positive direction of the Z-axis. With reference to FIG. 15, the arrayed-waveguide circuit 6 includes four waveguide circuit components $\mathbf{5}_1$ to $\mathbf{5}_4$ two-dimensionally disposed in the X-Y plane and a power-combining circuit component 70 connected to the output end portions of the waveguide circuit components $\mathbf{5}_1$ to $\mathbf{5}_4$.

Figure 16A:
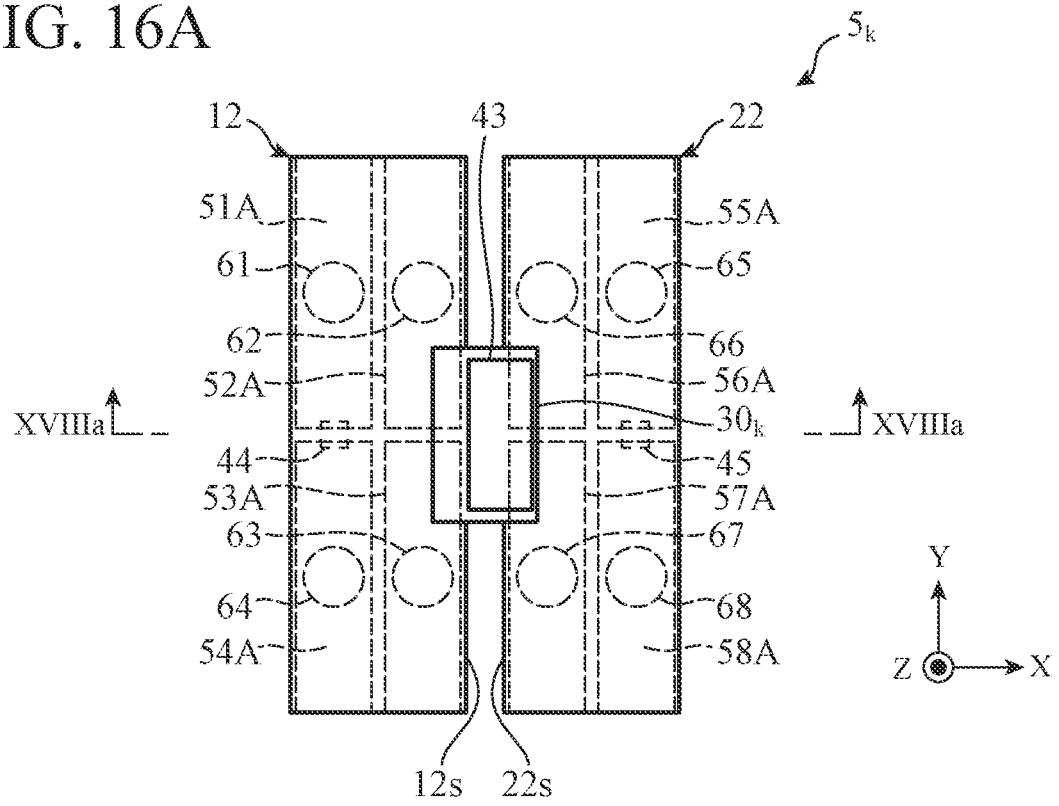
FIGS. 16A and 16B are schematic views of the configuration of a waveguide circuit component of the arrayed-waveguide circuit of the fourth embodiment.
Figure 16B:
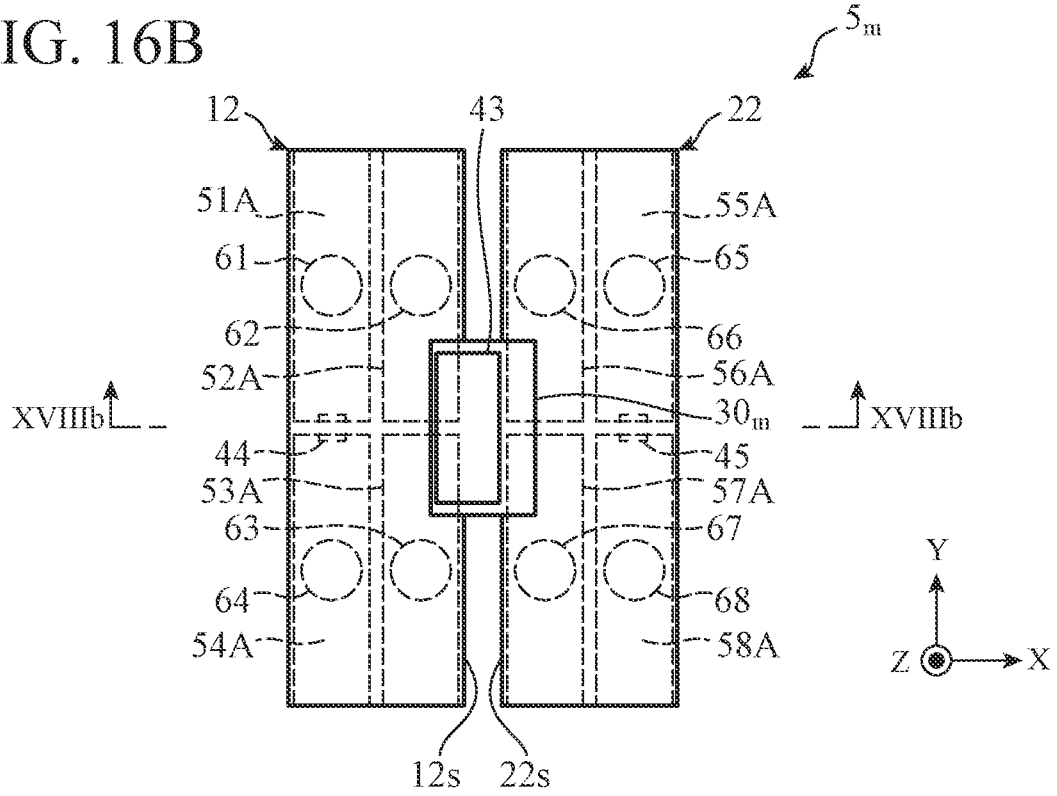
Figure 17:
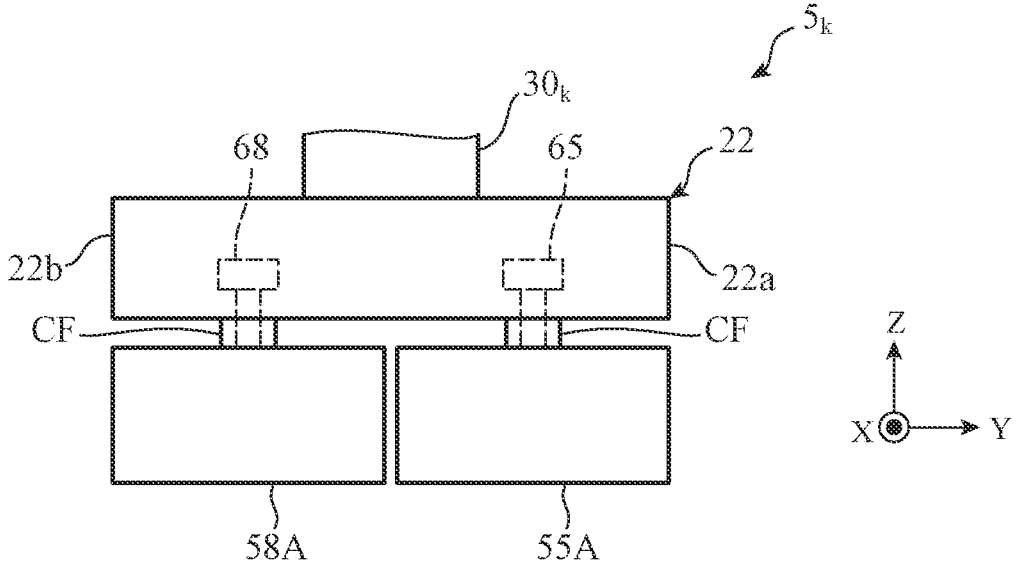
FIG. 17 is aright side view of the waveguide circuit component illustrated in FIG. 16A.
Figure 18A:
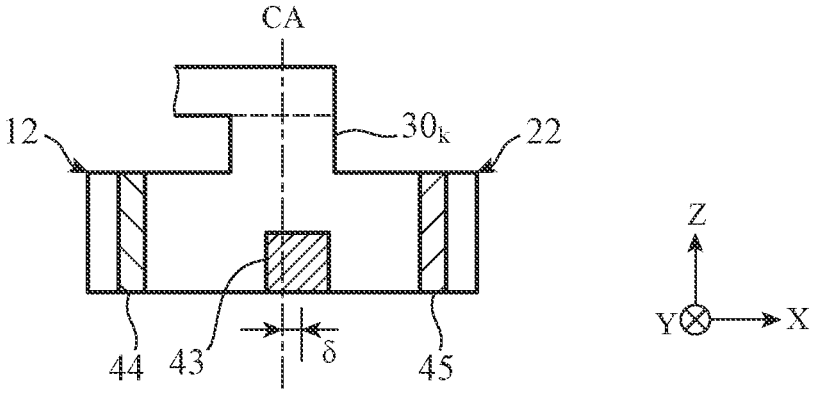
FIG. 18A is a cross-sectional view of the waveguide circuit component taken along line XVIIIa-XVIIIa in FIG. 16A.
Figure 18B:
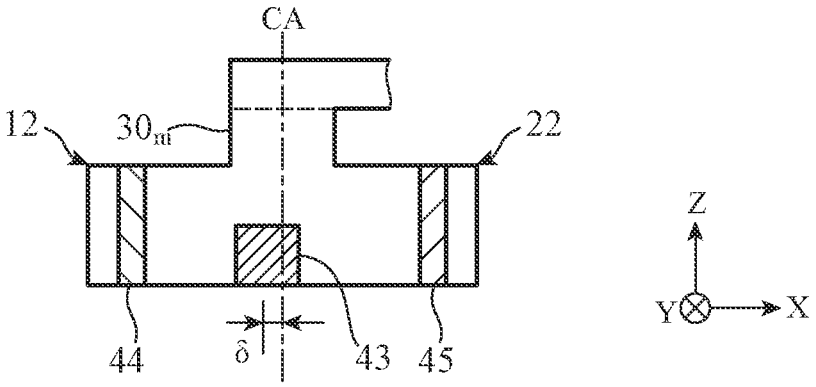
FIG. 18B is a cross-sectional view of the waveguide circuit component take along line XVIIIb-XVIIIb in FIG. 16B.
Figure 19:
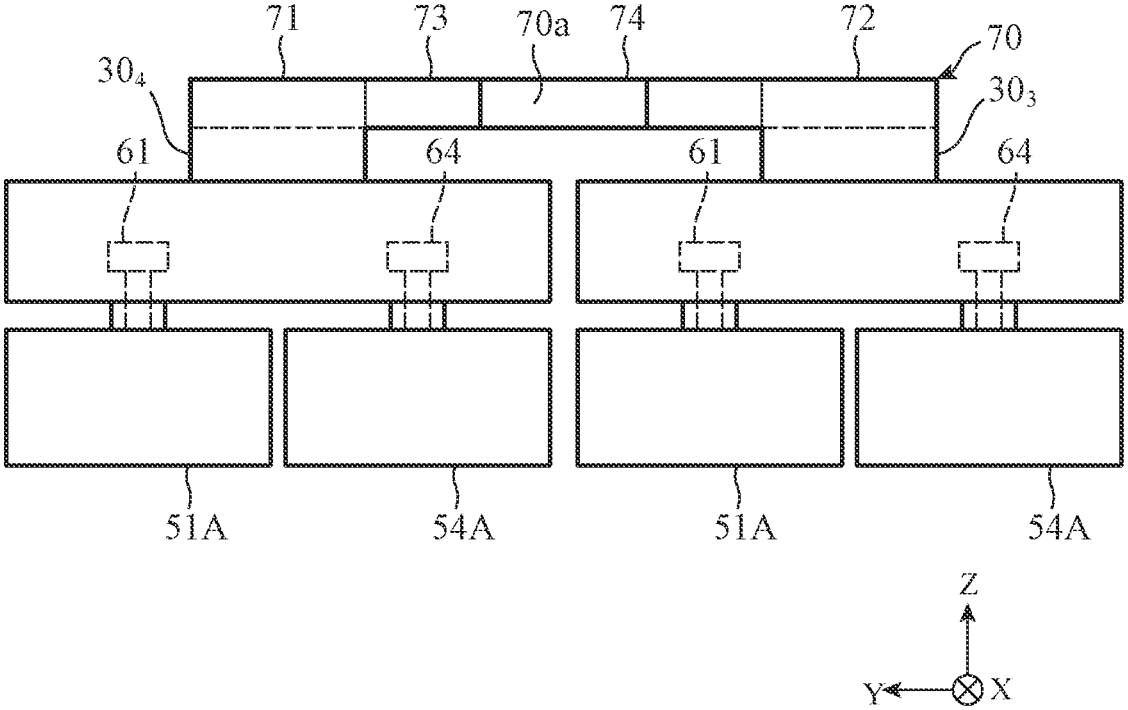
FIG. 19 is a left side view of the arrayed-waveguide circuit illustrated in FIG. 15.

FIG. 16A is a top view of a waveguide circuit component $\mathbf{5}_k$ (where k is 1 or 2) having the same configuration as that of the waveguide circuit component $\mathbf{5}_1$ or $\mathbf{5}_2$. FIG. 16B is a top view of a waveguide circuit component $\mathbf{5}_m$ (where m is 3 or 4) having the same configuration as that of the waveguide circuit component $\mathbf{5}_3$ or $\mathbf{5}_4$. FIG. 17 is a right side view of the waveguide circuit component $\mathbf{5}_k$ in FIG. 16A. FIG. 18A is a cross-sectional view of the waveguide circuit component $\mathbf{5}_k$ taken along line XVIIIa-XVIIIa in FIG. 16A. FIG. 18B is a cross-sectional view of the waveguide circuit component $\mathbf{5}_m$ taken along line XVIIIb-XVIIIb in FIG. 16B. FIG. 19 is a left side view of the arrayed-waveguide circuit 6 in FIG. 15 viewed from the negative direction of the X-axis.

The waveguide circuit component $\mathbf{5}_k$ in FIG. 16A includes a first waveguide tube 12, a second waveguide tube 22, and a third waveguide tube $\mathbf{30}_k$. A narrow sidewall 12*s* of the first waveguide tube 12 faces a narrow sidewall 22*s* of the second waveguide tube 22. The third waveguide tube $\mathbf{30}_k$ serves as an output end portion of the waveguide circuit component $\mathbf{5}_k$. The configuration of the waveguide circuit component $\mathbf{5}_k$ is the same as that of the waveguide circuit component 5

(FIG. 13) of the modified embodiment from the third embodiment, except that the third waveguide tube 30 is replaced with the third waveguide tube $\mathbf{30}_k$. The waveguide circuit component $\mathbf{5}_k$ of the present embodiment further includes three matching elements 43, 44, and 45 that alleviate the impedance mismatching among the first waveguide tube 12, the second waveguide tube 22, and the third waveguide tube $\mathbf{30}_k$. The matching elements 43, 44, and 45 may be composed of conductors, such as metals.

With reference to FIG. 18A, the matching element 43 is disposed at and near the center of the coupler on the tube axis (central axis) CA of the third waveguide tube $\mathbf{30}_k$. The matching element 44 is disposed in the hollow guide in the first waveguide tube 12 a predetermined distance away from the center of the coupler in the negative direction of the X-axis. With reference to FIG. 18A, the matching element 44 is in the form of a post protruding in a direction orthogonal to the tube axis of the first waveguide tube 12 (the positive direction of the Z-axis) and electrically connects the top and bottom walls of the first waveguide tube 12 to each other. The matching element 45 is disposed in the hollow guide in the second waveguide tube 22 a predetermined distance away from the center of the coupler in the positive direction of the X-axis. With reference to FIG. 18A, the matching element 45 is in the form of a post protruding in a direction orthogonal to the tube axis of the second waveguide tube 22 (the positive direction of the Z-axis) and electrically connects the top and bottom walls of the second waveguide tube 22 to each other. In view of alleviation of the impedance mismatching, it is preferred that the matching elements 44 and 45 each be disposed in an area away from the center of the coupler by a distance smaller than or equal to one half of the wavelength corresponding to a predetermined radio-frequency band.

With reference to FIG. 18A, the matching element 43 is disposed a distance 6 away from the center of the coupler of the third waveguide tube $\mathbf{30}_k$ in the positive direction of the X-axis.

The waveguide circuit component $\mathbf{5}_m$ illustrated in FIG. 16B includes a first waveguide tube 12, a second waveguide tube 22, and a third waveguide tube $\mathbf{30}_m$. The third waveguide tube $\mathbf{30}_m$ serves as an output end portion of the waveguide circuit component $\mathbf{5}_m$. The configuration of the waveguide circuit component $\mathbf{5}_m$ is the same as that of the waveguide circuit component $\mathbf{5}_k$ illustrated in FIG. 16A, except that the position of the matching element 43 differs. With reference to FIG. 18B, the matching element 43 of the waveguide circuit component $\mathbf{5}_m$ is disposed a distance 6 away from the center of the coupler of the third waveguide tube $\mathbf{30}_m$ in the negative direction of the X-axis.

Similar to the waveguide circuit components 5 described above, the waveguide circuit component $\mathbf{5}_k$ in FIG. 16A can combine the radio-frequency powers input through the amplifiers 51A to 58A to thereby generate a composite power, and can output the composite power from the output end of the third waveguide tube $\mathbf{31}_k$. Similarly, the waveguide circuit component $\mathbf{5}_m$ in FIG. 16B can combine the radio-frequency powers input through the amplifiers 51A to 58A to thereby generate a composite power, and can output the composite power from the output end of the third waveguide tube $\mathbf{31}_m$. Thus, the waveguide circuit components $\mathbf{5}_1$ to $\mathbf{5}_4$ of the arrayed-waveguide circuit 6 of the present embodiment receives 32 (=4×8) amplified radio-frequency signals as inputs in total. The third waveguide tubes $\mathbf{30}_1$ to $\mathbf{30}_4$ of the waveguide circuit components $\mathbf{5}_1$ to $\mathbf{5}_4$ can output four composite powers in total.

The power-combining circuit component 70 includes waveguide tubes 71, 72, 73, and 74 in a joined state. The power-combining circuit component 70 is disposed above the waveguide circuit components $\mathbf{5}_1$ to $\mathbf{5}_4$ (in the positive direction of the Z-axis) as illustrated in the lift side view of FIG. 19. With reference to FIG. 15, the both end portions of the waveguide tube 71 in the X-axis direction are connected to the third waveguide tube $\mathbf{30}_1$ of the waveguide circuit component $\mathbf{5}_1$ and the third waveguide tube $\mathbf{30}_4$ of the waveguide circuit component $\mathbf{5}_4$, respectively. With reference to FIG. 18A, the propagation direction of the wave output from the third waveguide tube $\mathbf{30}_k$ (k=1) is bent toward the left (negative direction of the X-axis) and enter a first end of the waveguide tube 71. The first end of the waveguide tube 71 and the third waveguide tube $\mathbf{30}_1$ constitute an E-plane (electric-field plane) bend EB1. The matching element 43 disposed at a position displaced by δin the positive direction of the X-axis can reduce the influence of impedance mismatch due to the influence of the E-plane bend EB1.

With reference to FIG. 18B, the propagation direction of the wave output from the third waveguide tube $\mathbf{30}_m$ (m=4) is bent toward the right (the positive direction of the X-axis) and enter a second end of the waveguide tube 71. The second end of the waveguide tube 71 and the third waveguide tube $\mathbf{30}_4$ constitute an E-plane bend EB4. The second end of the waveguide tube 71 and the third waveguide tube $\mathbf{30}_4$ constitute an E-plane bend EB2. The matching element 43 disposed at a position displaced by δ in the negative direction of the X-axis can reduce the influence of impedance mismatch due to the influence of the E-plane bend EB4.

With reference to FIG. 15, the central portion of the waveguide tube 71 is connected to a first end of the waveguide tube 73 extending along the Y-axis direction. The coupler of the waveguide tube 71 and the first end of the waveguide tube 73 constitute an H-plane (magnetic-field plane) tee T1. Thus, the radio-frequency waves, which propagate from the both end portions of the waveguide tube 71 in the positive and negative directions of the X-axis, respectively, are combined at the H-plane (magnetic-field plane) tee T1.

The both end portions of the waveguide tube 72 in the X-axis direction are connected to the third waveguide tube $\mathbf{30}_2$ of the waveguide circuit components $\mathbf{5}_2$ and the third waveguide tube $\mathbf{30}_3$ of the waveguide circuit components $\mathbf{5}_3$, respectively. The first end of the waveguide tube 72 and the third waveguide tube $\mathbf{30}_2$ constitute an E-plane bend EB2. The second end of the waveguide tube 72 and the third waveguide tube $\mathbf{30}_3$ constitute an E-plane bend EB3. The central portion of the waveguide tube 72 is connected to the second end of the waveguide tube 73 extending along the Y-axis direction. The coupler of the waveguide tube 72 and the second end of the waveguide tube 73 constitute an H-plane tee T2. Thus, the radio-frequency waves, which propagate from the both end portions of the waveguide tube 72 in the positive and negative directions of the X-axis, respectively, are combined at the H-plane tee T2.

The first end of the waveguide tube 74 is connected to the central portion of the waveguide tube 73, and the second end of the waveguide tube 74 serves as an output end 70*a*. The radio-frequency waves, which propagate from the both end portions of the waveguide tube 73 in the positive and negative directions of the Y-axis, respectively, are combined at the central portion of the waveguide tube 73. The combined radio-frequency waves then propagate through the waveguide tube 74 for output from the output end 70*a*. The power-combining circuit component 70 can combine the radio-frequency powers of four inputs from the waveguide circuit components $5_1$ to $5_4$ in accordance with a tournament or binary-tree method to thereby generate a composite power, and can output the composite power from the output end 70*a*.

As described above, the arrayed-waveguide circuit 6 of the fourth embodiment can combine radio-frequency powers input through the two-dimensionally arrayed-waveguide circuit components $5_1$ to $5_4$, thereby implementing a radio-frequency power source with an output power higher than that in the first to third embodiments.

Because the power-combining circuit component 70 includes the E-plane bends EB1 to EB4 and the H-plane tees T1 and T2, the power-combining circuit component 70 can have a small dimension in the thickness direction (Z-axis direction), as illustrated in FIG. 19. Thus, the present embodiment can provide a low-cost waveguide circuit having a relatively simple structure without a significant increase in the number of layers even when a large number of radio-frequency powers are to be combined.

In the present embodiment, the number of waveguide circuit components $5_1$ to $5_4$ is four, although no limitation thereto is intended. The configuration of the arrayed-waveguide circuit 6 can be appropriately modified by applying a two-dimensional array of two waveguide circuit components or five or more waveguide circuit components.

As described above, various embodiments according to the present invention have been described with reference to the drawings, which are examples of the present invention. Embodiments other than the above embodiments can be considered. For example, an arrayed-waveguide circuit may considered, which includes a two-dimensional array of waveguide circuit components each having the same configuration as that of any one of the waveguide circuits 1 to 3 of the first to third embodiments, and a power-combining circuit component connected to output end portions of the waveguide circuit components.

Within the scope of the invention, the first to fourth embodiment can be freely combined, any component of each embodiment can be modified, or any component of each embodiment can be omitted.

INDUSTRIAL APPLICABILITY

Waveguide circuits according to the present invention have structures capable of performing the power combining or splitting in a radio-frequency band such as a VHF band, a UHF band, a microwave band or a millimeter-wave band, and thus are suitable for use in, for example, a satellite-borne communication system, a mobile communication system, a radio-frequency power source, and a radio-frequency module of a radar system.

REFERENCE SIGNS LIST

1 to 5: waveguide circuits; $5_1$ to $5_4$: waveguide circuit components; 6: arrayed-waveguide circuit; 10 to 12: first waveguide tubes; 20 to 22: second waveguide tubes; 30, 31, $30_k$, $30_m$: third waveguide tubes; 40 to 45: matching elements; 51 to 58, 51A to 58A: amplifiers; 61 to 68: probes; 70: power-combining circuit component; 71 to 74: waveguide tubes; EB1 to EB4: E-plane bends; T1, T2: H-plane tees; and CF: coaxial guide.

The invention claimed is:

1. A waveguide circuit comprising:

a first waveguide tube having a first cross-sectional shape to allow propagation of a TE mode;

a second waveguide tube disposed adjacent to the first waveguide tube and having a second cross-sectional shape to allow propagation of a TE mode; and a third waveguide tube having a tube axis perpendicular to both a tube axis of the first waveguide tube and a tube axis of the second waveguide tube, and having a third cross-sectional shape to allow propagation of a TE mode, wherein, the first cross-sectional shape has a pair of straight-line long sides facing each other and a pair of straight-line short sides facing each other, in a plane orthogonal to the tube axis of the first waveguide tube, the second cross-sectional shape has a pair of straight-line long sides facing each other and a pair of straight-line short sides facing each other, in a plane orthogonal to the tube axis of the second waveguide tube, the first waveguide tube has a pair of sidewalls which form the pair of straight-line short sides of the first cross-sectional shape, the second waveguide tube has a pair of sidewalls which form the pair of straight-line short sides of the second cross-sectional shape, the pair of straight-line long sides of the second cross-sectional shape is parallel to the pair of straight-line long sides of the first cross-sectional shape, the tube axis of the second waveguide tube is parallel to the tube axis of the first waveguide tube, one sidewall of the pair of sidewalls of the second waveguide tube is disposed to face one sidewall of the pair of sidewalls of the first waveguide tube, and the third waveguide tube includes an input/output end at a first end of the third waveguide tube, and further includes a coupler at a second end of the third waveguide tube, the coupler connecting a hollow guide of the third waveguide tube to both a hollow guide of the first waveguide tube and a hollow guide of the second waveguide tube.

2. The waveguide circuit according to claim 1, wherein:

the third cross-sectional shape has a pair of straight-line long sides facing each other and a pair of straight-line short sides facing each other, in a plane orthogonal to the tube axis of the third waveguide tube;

the third waveguide tube has a pair of sidewalls which form the pair of straight-line short sides of the third cross-sectional shape; and the pair of sidewalls of the third waveguide tube intersects with both the one sidewall of the first waveguide tube and the one sidewall of the second waveguide tube.

3. The waveguide circuit according to claim 1, wherein the hollow guide of at least one waveguide tube of the first waveguide tube and the second waveguide tube includes a matching element, the matching element being disposed at a position that is away from a center of the coupler by a distance smaller than or equal to one half of a wavelength corresponding to a predetermined radio-frequency band, in a direction perpendicular to the tube axis of the first waveguide tube.

4. The waveguide circuit according to claim 3, wherein the matching element is an electrical conductor that protrudes in a direction perpendicular to the tube axis of said at least one waveguide tube and electrically connects the mutually facing sidewalls of said at least one waveguide tube to each other.

5. The waveguide circuit according to claim 3, wherein the coupler includes another matching element.

6. The waveguide circuit according to claim 1, further comprising:

at least two coaxial-to-waveguide transitions disposed in the hollow guide of the first waveguide tube and in respective areas on both sides of the coupler in a direction along the tube axis of the first waveguide tube; and at least two coaxial-to-waveguide transitions disposed in the hollow guide of the second waveguide tube and in respective areas on both sides of the coupler in a direction along the tube axis of the second waveguide tube.

7. The waveguide circuit according to claim 1, wherein each of the first cross-sectional shape, the second cross-sectional shape and the third cross-sectional shape is rectangular.

8. An arrayed-waveguide circuit comprising:

a plurality of waveguide circuit components arranged in a two-dimensional array; and a power-combining circuit component connected to output end portions of the waveguide circuit components, wherein each of the waveguide circuit components comprises the waveguide circuit according to claim 1.

9. The arrayed-waveguide circuit according to claim 8, wherein the power-combining circuit component includes:

a plurality of E-plane bends connected to the output end portions of the waveguide circuit components, respectively; and at least one H-plane tee connected to output ends of the E-plane bends.

10. The arrayed-waveguide circuit according to claim 8, wherein:

the third cross-sectional shape has a pair of straight-line long sides facing each other and a pair of straight-line short sides facing each other, in a plane orthogonal to the tube axis of the third waveguide tube;

the third waveguide tube has a pair of sidewalls which form the pair of straight-line short sides of the third cross-sectional shape; and the pair of sidewalls of the third waveguide tube intersects with both the one sidewall of the first waveguide tube and the one sidewall of the second waveguide tube.

11. The arrayed-waveguide circuit according to claim 8, wherein the hollow guide of at least one waveguide tube of the first waveguide tube and the second waveguide tube includes a matching element, the matching element being disposed at a position that is away from a center of the coupler by a distance smaller than or equal to one half of a wavelength corresponding to a predetermined radio-frequency band, in a direction perpendicular to the tube axis of the first waveguide tube.

12. The arrayed-waveguide circuit according to claim 11, wherein the matching element is an electrical conductor that protrudes in a direction perpendicular to the tube axis of said at least one waveguide tube and electrically connects the mutually facing sidewalls of said at least one waveguide tube to each other.

13. The waveguide circuit according to claim 11, wherein the coupler includes another matching element.

14. The arrayed-waveguide circuit according to claim 8, further comprising:

at least two coaxial-to-waveguide transitions disposed in the hollow guide of the first waveguide tube and in respective areas on both sides of the coupler in a direction along the tube axis of the first waveguide tube; and at least two coaxial-to-waveguide transitions disposed in the hollow guide of the second waveguide tube and in respective areas on both sides of the coupler in a direction along the tube axis of the second waveguide tube.

15. The arrayed-waveguide circuit according to claim 8, wherein each of the first cross-sectional shape, the second cross-sectional shape and the third cross-sectional shape is rectangular.

* * * * *